US006640712B2

(12) United States Patent
Corti et al.

(10) Patent No.: US 6,640,712 B2
(45) Date of Patent: Nov. 4, 2003

(54) APPARATUS FOR CLEANING ALTERNATIVELY TWO OR MORE CYLINDERS OF A PRINTING MACHINE BY MEANS OF A SINGLE CLEANING DEVICE

(76) Inventors: Marco Corti, Via Fornaci 16, I-23900 Lecco (IT); Riccardo Fumagalli, Via Baravico 41, I-23848 Oggiono (IT)

( * ) Notice: Subject to any disclaimer, the term of this patent is extended or adjusted under 35 U.S.C. 154(b) by 21 days.

(21) Appl. No.: 09/946,529

(22) Filed: Sep. 6, 2001

(65) Prior Publication Data

US 2002/0029707 A1 Mar. 14, 2002

(30) Foreign Application Priority Data

Sep. 8, 2000 (IT) ..... BO2000A0521

(51) Int. Cl.[7] ..... B41F 23/04
(52) U.S. Cl. ..... 101/425; 101/423
(58) Field of Search ..... 101/425, 423, 101/424; 15/256.5, 256.51, 256.52, 256.53

(56) References Cited

U.S. PATENT DOCUMENTS 4,981,078 A * 1/1991 Dettinger et al. ..... 101/424
5,408,930 A 4/1995 Loos ..... 101/423
5,479,857 A 1/1996 Braun ..... 101/423
5,921,182 A * 7/1999 Becker et al. ..... 101/425
6,341,558 B1 * 1/2002 Hanke et al. ..... 101/425

FOREIGN PATENT DOCUMENTS

EP 1 155 859 A2 11/2001

* cited by examiner

*Primary Examiner*—Andrew H. Hirshfeld
*Assistant Examiner*—Anthony H. Nguyen
(74) *Attorney, Agent, or Firm*—Larson & Taylor PLC

(57) ABSTRACT

A cleaning device is attached at each end to shoulders pivoting on a pair of parallel arms hinged at the other end to the side walls of a machine. There pivots on at least one of the arms an assembly of pneumatic actuators, which actuators pivot at the other end on a lug integral with one of the shoulders, which shoulders are provided with spindles or rollers that run in cam paths formed in plates attached to the side walls. The cleaning device can be oriented and positioned against either of the two cylinders to be cleaned or can be set in a position remote from both of these cylinders. Mounted on at least one of the arms or on both of the shoulders are idle rollers designed to engage with corresponding cams, so that the cleaning device is moved away automatically whenever it passes over the clamps.

13 Claims, 4 Drawing Sheets

APPARATUS FOR CLEANING ALTERNATIVELY TWO OR MORE CYLINDERS OF A PRINTING MACHINE BY MEANS OF A SINGLE CLEANING DEVICE

The invention relates to an apparatus for cleaning alternatively and at will two or more neighbouring cylinders in a printing machine, by means of a single cleaning device.

Examples of such equipment are described in U.S. Pat. No. 5,408,930 (Loos) and U.S. Pat. No. 5,479,857 (Braun) where the cleaning apparatus can rotate about an axis parallel to the presser which can thus be oriented alternatively against either of two parallel neighbouring cylinders inside the printing machine. Once the presser is correctly oriented relative to a cylinder, it is deformed elastically and/or pushed towards that cylinder so as to touch it with the cloth, which is soaked with the cleansing fluids. These devices are not designed to also operate on cylinders in which there are gaps on the surface, containing for example clamps, as for instance in plate cylinders, in which the cleaning cloth could interfere with the said clamps and be torn. Also known is the device disclosed in PCT patent application WO 00/34045 in the name of the present applicants, where the cleaning device is supported by means which on command enable it to perform a rotary or pivoting movement about an axis, possibly represented by an actual shaft, that is parallel to and located between the two cylinders to be cleaned, while other means cause the same cleaning device to perform a simultaneous rotary or pivoting movement about their own longitudinal axis which passes through the points of attachment to the said supporting means. This device, unlike the US patent devices mentioned above, includes a component of displacement perpendicular to the cylinder that is to be cleaned, and this component is made use of to ensure that the device can automatically avoid interference between the cleaning cloth and the clamps of a plate cylinder. To this end the cleaning device is provided on at least one end with an idle roller able to engage with at least one cam mounted at the side of the plate cylinder, across the gap containing the clamps. When the roller encounters this cam, the cleaning device automatically backs away from the cylinder it is cleaning, thus avoiding interfering with the clamps, and once the cam has been passed, the said cleaning device moves back into contact with the cylinder under the elastic force exerted by the pneumatic actuators by which the movement of the device is controlled.

The above device presupposes the existence between the cylinders to be cleaned, and parallel with these cylinders, of a shaft which the device uses as a fulcrum means. For cases where no such shaft exists, the same applicants devised an apparatus disclosed in European patent application No. 01 11 2119.1 filed May 17, 2001 which exploits the cleaning device itself as a torsion bar and provides a rack-and-pinion mechanism. This apparatus preserves the advantage of the automatic backing away from the clamps of the plate cylinder, as in the previous apparatus, but takes up an excessive amount of space transversely because the means by which the cleaning device is guided and moved are all located at the opposing ends of the device and greatly increase the length or width of the entire apparatus. This apparatus is therefore suitable for printing machines in which the ends of the cylinders are sufficiently distant from the side walls of the machine frame in which they are supported or in all those cases where the printing plate occupies only part of the length or breadth of the cylinder carrying it.

The invention relates to an apparatus that performs the same functions as the apparatuses disclosed in the Italian patent application indicated above, but unlike these can be mounted on printing machines that have no shaft mounted parallel to and located between the cylinders that are to be cleaned and in which the ends of the cylinders are at perhaps only a short distance from the supporting side walls, or even where the printing plates occupy almost the whole length or breadth of their cylinder, the said apparatus having only very small fittings added to the ends of the cleaning device. According to the invention, the cleaning device is mounted via its ends on shoulders that pivot on a pair of parallel arms, these arms being hinged at their other end to the machine side walls and connected to each other by a robust torsion bar. The said shoulders are provided, at an exact distance from the point where they hinge on the said arms, with rollers that follow the profile of linear cams mounted on the said machine side walls, while at a point at approximately one hundred and eighty degrees away from the said rollers, at least one of the shoulders pivots on the rod of a linear assembly of pneumatic actuators, which assembly pivots at the other end on a point of the arm close to the point where the latter pivots on its respective machine side wall. By means of the assembly of pneumatic actuators and of the said linear cams, the cleaning device can be oriented at will against either of these cylinders to be cleaned or can be set in a position remote from both the cylinders, this position being useful as a rest position and a position for maintenance of the apparatus. Mounted on at least one of the said arms, in an intermediate position, is an idle roller designed to engage with a corresponding cam situated at the end of the plate cylinder, across the gap containing the clamps, so that the cleaning device is automatically moved away whenever it passes over the said clamps, thus preventing any interference with these.

Other features of the invention, and the advantages procured thereby, will become clearer in the course of the following description of one preferred embodiment, illustrated purely by way of non-restrictive example, in the figures of the attached sheets of drawings, in which.

FIGS. 1–4 show that the cleaning apparatus comprises for example a bar B that supports, in such a way that it can move parallel to the bar by its own means, the presser P. The bar B also supports the assembly comprising the nozzles that dispense washing fluid onto the cloth T, which is unwound by suitable means from a roller R1, around the assembly B, P and onto a roller R2, these means being supported by parallel shoulders S. It should be understood that the cleaning device may be of any known type and even different from that indicated above, for example of the type that comprises a brush placed in contact with the cylinder to be cleaned, onto which the cleansing fluid is dispensed uniformly. The only condition which the cleaning device must have to be able to be used with the improvements described herein, is that it must form with the shoulders S a sufficiently rigid structure with a good degree of resistance to torsional stresses.

Figure 5:
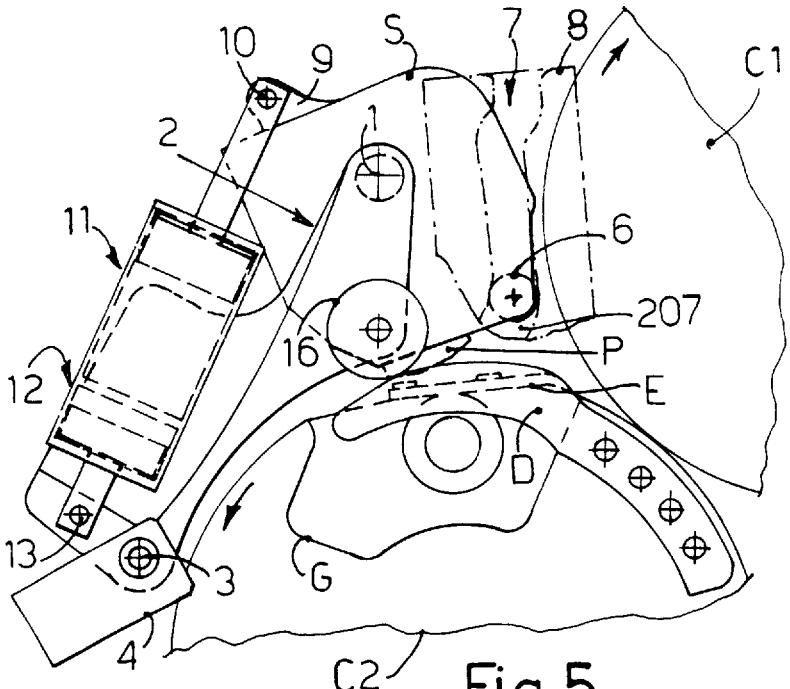
FIGS. 5, 6 and 7 illustrate the apparatus from the side and during successive stages of engagement with the cams which prevent interference between the cleaning cloth and the clamps that hold the plate on the plate cylinder.
Figure 6:
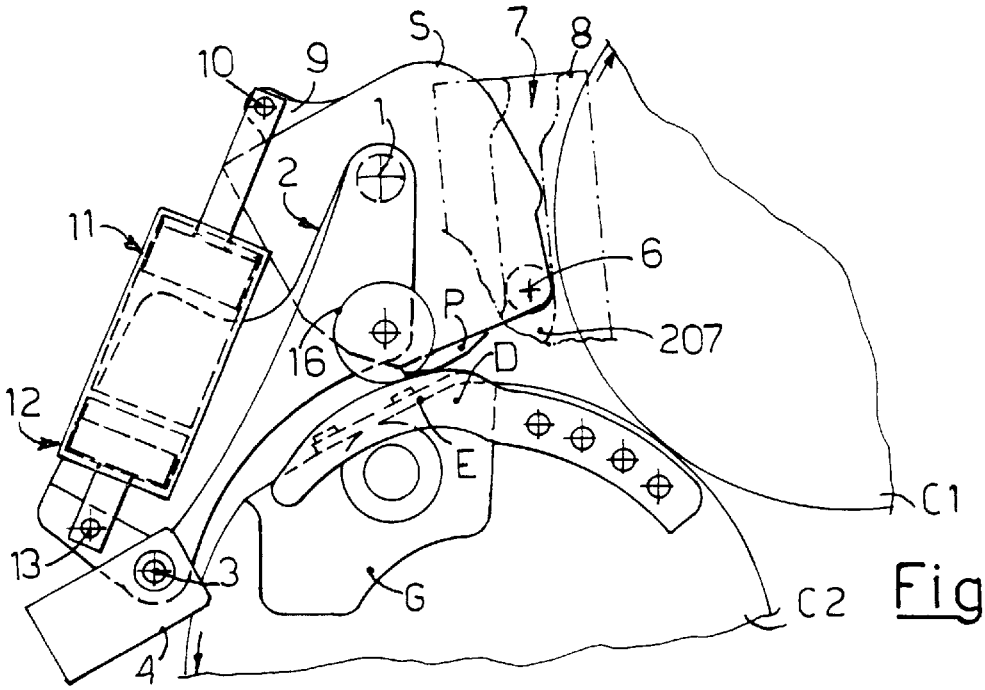
Figure 7:
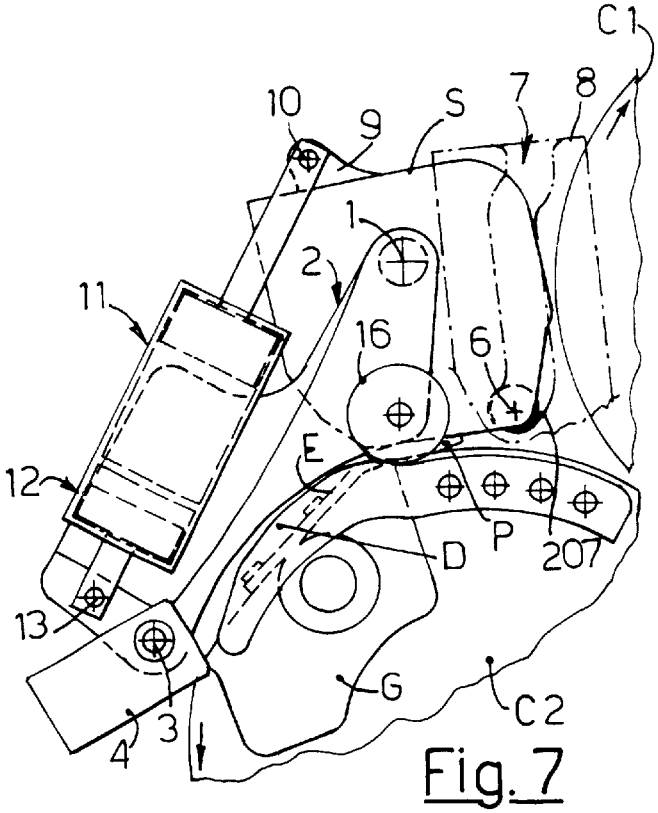

In FIGS. 1–4, C1 indicates the upper or blanket cylinder, which in this example is in contact, at a position corresponding to approximately one or two o'clock, with the lower or plate cylinder C2. The latter has one or more gaps G containing clamps E and fitted at either side with cams D that bridge these gaps G (FIGS. 5–7). The cleaning apparatus is positioned near the region of mutual contact between the cylinders C1 and C2 to be cleaned, alongside the upper cylinder Cl and above the lower cylinder C2, parallel to both cylinders, and comprises identical fulcrums/spindles 1 aligned axially with each other and fixed perpendicularly to the outer flank of the shoulders S, roughly in the centre of these and parallel to the components B, P, R1, R2. These fulcrums/spindles 1 enable the components to pivot on the ends of arms 2 whose other ends pivot at fulcrums 3 on plates 4 fixed to the side walls F of the printing machine. The arms 2 are interconnected by a robust cross member or torsion bar 5, which synchronizes them in their pivoting movement about the fulcrums 3, and are characterized beneath by a curved profile 102 enabling them to operate close up to ends of the lower cylinder C2.

Figure 2:
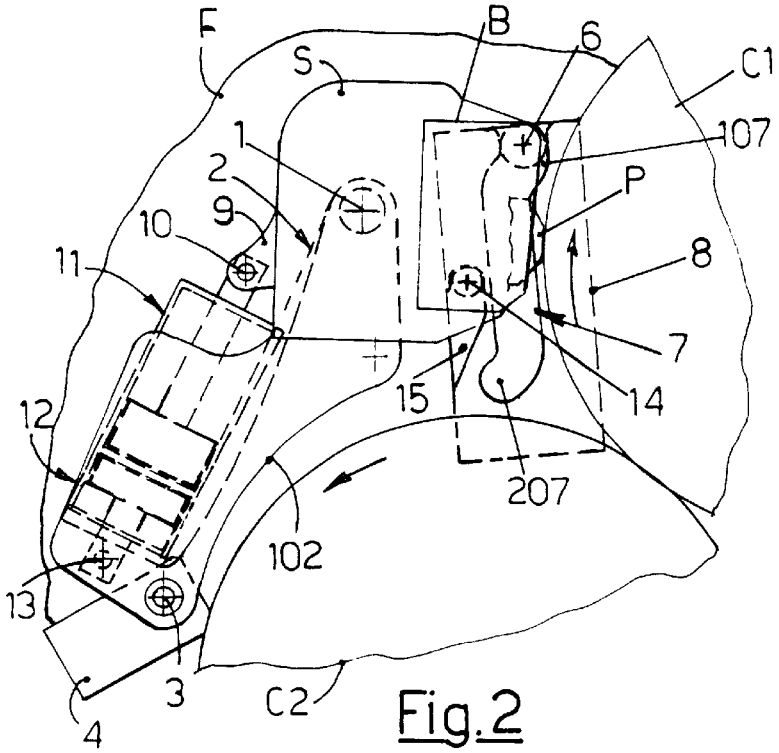
FIGS. 2, 3 and 4 are side views of the apparatus in the position of cleaning the blanket cylinder, the position of cleaning the plate cylinder and the rest position, respectively.

The shoulders S also have on the outer flank, parallel to the fulcrums/spindles 1 and above the presser P when the latter is oriented towards the cylinder C1 as in FIG. 2, corresponding rollers or bearings 6 which engage in respective cam tracks 7 formed in plates 8 fixed to the side walls F of the printing machine. The cams 7 are characterized by having for example a generally Z-shaped design, with an intermediate straight and roughly vertical section, an upper section 107 inclined at for example about 45° towards the cylinder C1 and open at the top, and a lower section 207 inclined at approximately 45° in the opposite direction to the upper section 107. These parameters are of course dependent on the relative positions of the cylinders illustrated in the drawings and are therefore subject to change depending on how the cylinders are positioned.

Opposite the roller 6 of one of the shoulders S is a lug 9 providing a pivot at 10 for the rod of a double-acting pneumatic actuator 11, the base of the body of which is fixed to the base of a second double-acting pneumatic actuator 12. The stroke of the second actuator 12 is shorter than that of the first actuator and its own rod pivots at 13 on the flank of the neighbouring arm 2, a short distance from its fulcrum 3.

When the rods of both actuators 11 and 12 are retracted, as in FIG. 2, the rollers 6 of the shoulders S are positioned at the end of the upper inclined section 107 of the cams 7 and the presser P is oriented in the correct position for cleaning the cylinder C1 which is rotating clockwise, for example. The pressure of the presser P against the cylinder C1 tends, because of the reaction of the apparatus on the rollers 6, to push the fulcrums/spindles 1 away from C1. This displacement is opposed by the actuators 11, 12 or can be usefully opposed by spindles 14 parallel to the rollers 6 and, like them, fixed to the outer flank of one or both of the shoulders S, which fit into rising paths 15 formed in the inner flanks of the plates 8, which essentially repeat the profile of the upper terminal section 107 of the cams 7 and which are open towards the arms 2. When the apparatus is in the configuration of FIG. 2, the spindles 14 press against the blind upper end of the paths 15 and prevent any movement of the fulcrums/spindles 1 away from C1.

Figure 4:
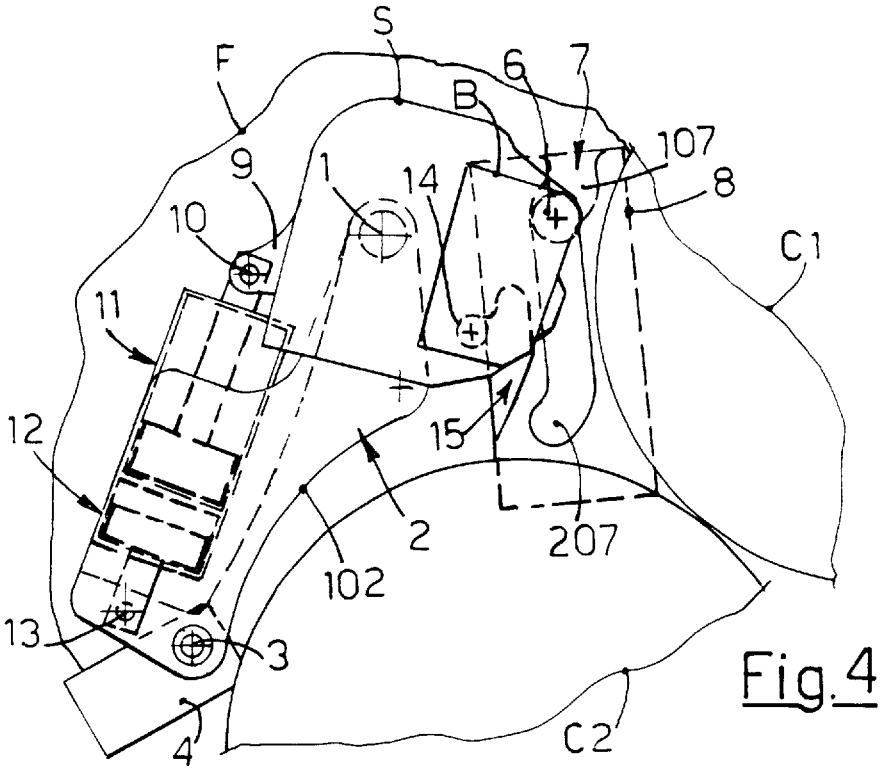

When the short-stroke actuator 12 extends its rod, the apparatus adopts the condition shown in FIG. 4, with the rollers 6 moving down to the top of the straight section of the cams 7, the spindles 14 coming out of the paths 15, and the working face of the presser P moving away from the cylinder C1 into the next region between the cylinders C1, C2. In this condition the apparatus is at rest and permits easy replacement of the cleaning cloth and maintenance of the various parts of this apparatus.

Figure 3:
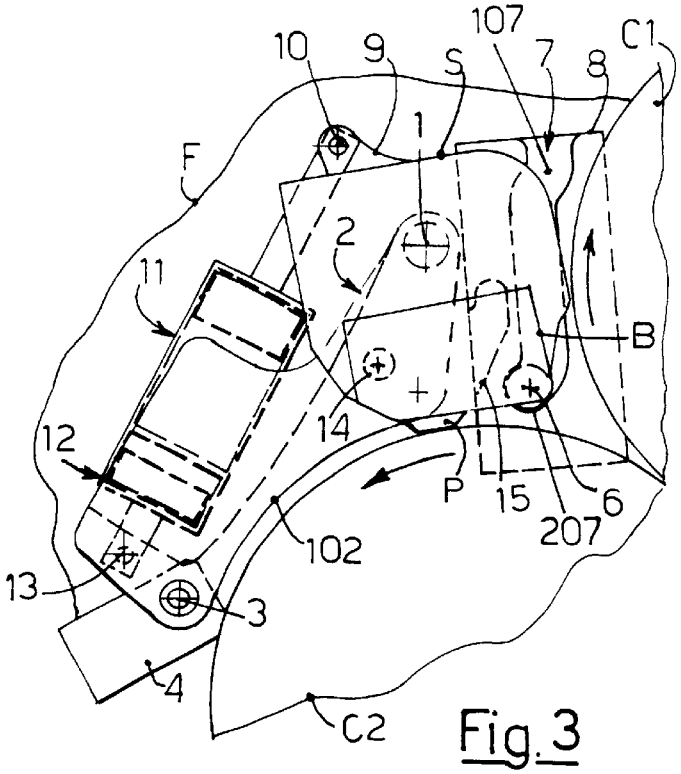

When the rod of the actuator 12 is extended and that of the actuator 11 is also extended, the rollers 6 travel down the cams 7 to the blind end of the inclined lower terminal section 207 of these cams as illustrated in FIG. 3. In this position the pressure of the presser P on the cylinder C2 tends to push the fulcrums/spindles 1 away from C2, except that this displacement is opposed by the fact that the profile of the said inclined blind lower section 207 of the cams 7 is effectively perpendicular to such displacement, so that the apparatus remains firmly in the working position on C2.

In order that, when the apparatus is working on the cylinder C2, the cloth pushed by the presser P does not interfere with the clamps E of the said cylinder, a roller 16 is mounted rotatably at an intermediate point on at least one of the arms 2: when acted upon by the cam or cams D attached to at least one corresponding flank of C2, across the gap or gaps containing the said clamps, it causes the assembly 2, 5 to pivot away from C2, as illustrated in the succession shown in FIGS. 5, 6 and 7, where it can be seen that this movement pushes the shoulders S anticlockwise and at the same time away from C2, while the rollers 6 climb back up the inclined lower section of the cams 7, so that there is automatically no interference between the presser carrying the cloth and the clamps E illustrated in broken lines. The said automatic retraction of the presser P from C2 occurs with a simultaneous and proportional retraction of the rods of the actuators 11, 12 which are constantly under pressure to extend by the pressed air, in such a way that after passing over the cam D, the apparatus automatically returns the presser and the cloth into contact with the cylinder C2. It should be understood that, in contrast to the illustrations and as is clear from FIG. 5, rollers 16 may be placed on both the shoulders S of the cleaning device rather than on at least one of the pivoting arms 2, thus resulting in the desired automatic separation of the cleaning device from the cylinder C2 whenever the clamps E pass under it.

Figure 1:
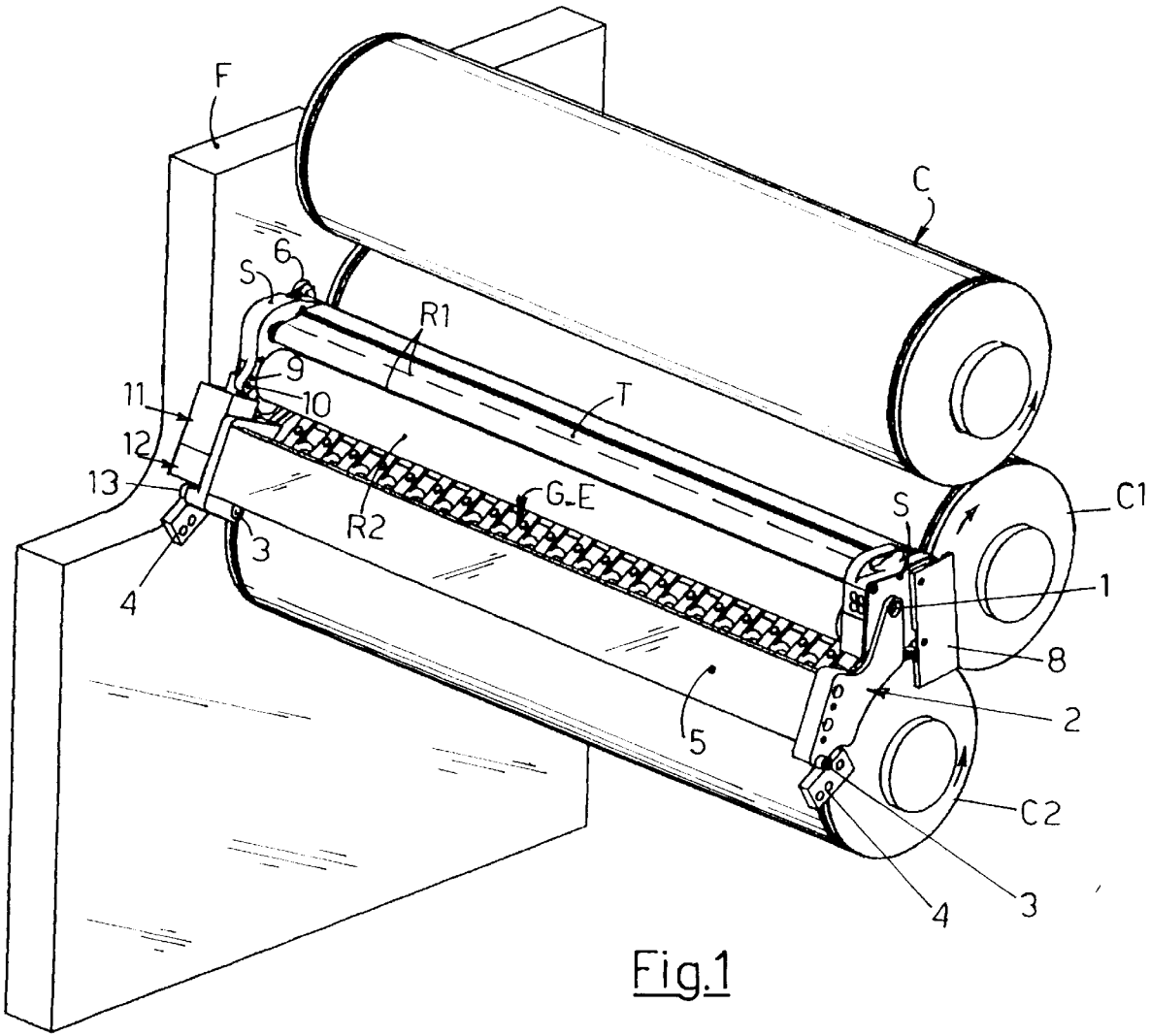
FIG. 1 is a perspective view of the apparatus in the condition of cleaning the blanket cylinder.

It will be understood that the description has been given with reference to a preferred embodiment of the invention, to which numerous variation modifications can be made, especially from the point of view of construction, relating for example to setting up the apparatus in such a way that it can at will clean the cylinder C2, or cylinder C1 or a higher cylinder C as illustrated in FIG. 1. Other variants may relate to the shape of the cams 7 or the orientation of the entire apparatus and its components, which may vary depending on the disposition of the cylinders to be cleaned with respect to the horizontal and vertical planes and depending on the relative dispositions of the cylinders themselves.

What is claimed is:

1. Apparatus for alternatively cleaning two adjacent cylinders supported between first and second side walls of a printing machine, said apparatus comprising:

a single cleaning device set parallel to and between the two cylinders, said cleaning device (a) having a longitudinal axis, (b) having first and second end shoulders at opposite longitudinal ends thereof, (c) forming an overall structure having resistance to torsional stresses, and (d) having a cleaning member which selectively contacts the first and second cylinders to be cleaned;

first and second spindles attached to outer flanks of said first and second end shoulders and aligned (a) axially with each other, (b) parallel to the longitudinal axis of the cleaning device and (c) at a suitable distance from the cleaning member;

first and second parallel arms having (a) respective first and second distal ends, (b) respective first and second intermediate parts, and (c) respective first and second proximal ends, said first and second distal ends being respectively connected to said first and second spindles such that respective said first and second end shoulders pivot on respective first and second distal ends of the respective said first and second parallel arms;

a cross member which connects respective said first and second intermediate parts of said first and second parallel arms;

first and second plates fixed to the respective first and second side walls of the printing machine and on which said first and second parallel arms respectively pivot at respective said first and second proximal ends thereof;

an assembly of pneumatic actuators having (a) a proximal end which is pivotally mounted to said first proximal end of said first parallel arm, and (b) a distal end;

a lug integral with one side of the first shoulder of the cleaning device to which the distal end of said assembly of pneumatic is pivotally attached;

first and second rollers carried respectively by said first and second shoulders on respective opposite sides thereof from said lug and integrally on outer flanks of said first and second shoulders;

first and second plates attached to the side walls of the printing machine and having formed therein respective first and second slotted cams having slotted profiles in which respective said first and second rollers ride;

such that as a result of an extension or retraction of said assembly of pneumatic actuators, the first and second shoulders rotate in one direction or the other and position themselves so that said first and second rollers are at either of suitably profiled and oriented ends of said first and second slotted cams, in order to orient and correctly position the cleaning member of the cleaning device against one or other of the two cylinders to be cleaned.

2. Apparatus according to claim 1:

wherein one of the two cylinders includes a gap in which clamps are located; and further including (a) an idle roller provided at an intermediate position on one of the first and second parallel arms, and (b) a cam attached to a flank of the one of said two cylinders across the gap and in position to engage said idle roller in order automatically to lift said cleaning device and to prevent interference between the cleaning member and the clamps located in the gaps.

3. Apparatus according to claim 1:

wherein one of the two cylinders includes a gap in which clamps are located; and further including (a) first and second idle gap rollers attached to the first and second shoulders of the cleaning device laterally alongside the cleaning member, and (b) first and second gap cams respectively attached to first and second flanks of the one of the two cylinders alongside the gap and in positions to respectively engage said first and second idle gap rollers in order automatically to lift said cleaning device whenever said first and second gap cams pass under said first and second gap rollers to prevent interference between said cleaning member and the clamps located in the gap.

4. Apparatus according to claim 1:

wherein the two cylinders to be cleaned are positioned one above the other defining upper and lower cylinders, with the upper cylinder touching the lower cylinder at approximately between one or two o'clock;

wherein the first and second slotted cams are located at a side of and a short distance from the upper cylinder and the slotted profiles are that of a broken line, with (a) a straight, almost vertical intermediate section, (b) an upper section, and (c) a lower section that is inclined at approximately 45° with respect to the intermediate section, and oriented in the opposite direction to the upper section.

5. Apparatus according to claim 4, wherein a terminal end sections of each of the lower sections of the slotted profiles of the fixed cams is oriented so as to oppose a displacement to which the cleaning device would be subject as a result of a force which said cleaning member exerts on the cylinder that is to be cleaned.

6. Apparatus according to claim 4:

wherein the lower cylinder includes a gap in which clamps are located;

further including (a) an idle roller operatively connected to said cleaning device, and (b) a gap cam operatively connected to the lower cylinder across the gap and in position to engage said idle roller in order automatically to lift said cleaning device and to prevent interference between the cleaning member and the clamps located in the gap;

wherein each lower section of the slotted profiles of said first and second slotted cams is blind and is oriented in such a way as to allow a free lifting therein of the respective said first and second end spindles whenever the idle roller is acted upon by the gap cam to prevent interference between the cleaning member of the cleaning device and the clamps of the lower cylinder.

7. Apparatus according to claim 1, further including, in order to enhance a stability of said cleaning device when said cleaning device is in a position of cleaning an upper one of the two cylinders:

(a) a third spindle located on the outer flanks of one of the first and second end shoulders of the cleaning device, and (b) a third cam having a blind rising path formed in the one of the first and second plate associated with said one of said first and second end shoulders, said third spindle fitting into said blind rising path and when said third spindle is located in an upper end of the blind rising path, said third spindle prevents any movement of the cleaning device away from the upper cylinder when the cleaning member is being pressed against the upper cylinder.

8. Apparatus according to claim 7, wherein said blind rising path has a profile and an orientation that essentially repeats that of the upper terminal section of the adjacent one of the first and second slotted cams.

9. Apparatus according to claim 1, wherein the first and second parallel arms each have a curved profile facing a most adjacent one of the two cylinders enabling the first and second parallel arms to operate in close proximity to adjacent one of the two cylinders.

10. Apparatus according to claim 1, wherein the assembly of pneumatic actuators comprises first and second actuators having respective different length strokes, said first and second actuators being axially aligned with each other and fixed to each other via adjacent bases, said first and second actuators providing at least the following three working conditions:

(a) when rods of the first and second actuators are extended, the cleaning device is in the position of cleaning a lowermost one of the two cylinders;

(b) when the rods of the first and second actuators are retracted, the cleaning device is in the position of cleaning an uppermost one of the two cylinders; and (c) when the rod of the longer-stroke one of the first and second actuators is extended and that of the shorter-stroke one of the first and second actuators is retracted, the cleaning device has the cleaning member located away from both of the two cylinders, in a position of rest useful for maintenance operations.

11. Apparatus according to claim 4:

wherein the upper sections of the slotted profiles are inclined at an angle of between 20° and 70° with respect to the intermediate section, and are oriented towards the upper cylinder.

12. Apparatus according to claim 11:

wherein the upper sections of the slotted profiles are inclined at an angle of approximately 45° and are open at a top thereof; and wherein the lower sections are blind.

13. Apparatus according to claim 5, wherein terminal end sections of each of the upper sections of the slotted profiles is oriented so as to oppose a displacement to which the cleaning device would be subject as a result of a force which said cleaning member exerts on the cylinder that is to be cleaned.

* * * * *